US006141571A

United States Patent [19]

Dionne

[11] Patent Number: 6,141,571

[45] Date of Patent: Oct. 31, 2000

[54] MAGNETICALLY TUNABLE FERRITE MICROWAVE DEVICES

[75] Inventor: Gerald F. Dionne, Winchester, Mass.

[73] Assignee: Massachusetts Institute of Technology, Cambridge, Mass.

[21] Appl. No.: 09/027,387

[22] Filed: Feb. 20, 1998

Related U.S. Application Data

[63] Continuation-in-part of application No. 08/738,635, Oct. 29, 1996, abandoned.

[51] Int. Cl.[7] ..... H01P 1/217; H01P 1/387; H01P 7/08; H01B 12/02

[52] U.S. Cl. ..... 505/210; 505/211; 505/700; 505/866; 333/99.005; 333/205; 333/219.2; 333/235; 333/161; 333/1.1

[58] Field of Search ..... 333/205, 219.2, 333/235, 995, 161, 156, 1.1; 505/210, 211, 700, 866

[56] References Cited

U.S. PATENT DOCUMENTS

| | | | |
|---|---|---|---|
| 3,257,629 | 6/1966 | Kornreich et al. | 333/161 |
| 3,304,519 | 2/1967 | Weiss | 333/1.1 |
| 4,853,660 | 8/1989 | Schloemann | 333/204 |
| 5,484,765 | 1/1996 | Dionne et al. | 505/210 |
| 5,770,546 | 6/1998 | Grothe et al. | 333/205 X |

OTHER PUBLICATIONS

W.J. Ince, et al., "Phasers and Time Delay Elements," Advances in Microwaves, vol. 4, pp. 115–119, 85–96 (1969).

G.F. Dionne, et al., "Ferrite–Superconductor Devices for Advanced Microwave Applications," IEEE Transactions on Microwave theory and Techniques, vol. 44(7):1361–1367 (Jul. 1996).

G.F. Dionne, et al., "A Ferrite Bonding Method with Magnetic Continuity," IEEE Transactions on Magnetics, vol. Mag–22(5):620–622 (Sep. 1986).

W.H. Von Aulock, "Selection of Ferrite Materials for Microwave Device Applications," IEEE Transactions on Magnetics, vol. Mag–2, No. 3:251–255 664–673 (Sep. 1966).

T. Min, et al., "Bicrystal Advanced Thin–Film Media for High Density Recording," J. Appl. Phys. 75(10):6129–6131 (May 15, 1994).

"Magnetic Properties of Vapor Grown Crystals of Hexagonal Chromium Telluride," J. Phys. Chem. Solids, vol. 34, pp. 1453–1455 (1973).

Y.S. Shur, et al., "Domain Structure and Magnetic Hysteresis in Single–Crystal MnBi Films," Sov. Phys. Solid State, 17(4):627–628 (1975).

(List continued on next page.)

*Primary Examiner*—Benny T. Lee
*Attorney, Agent, or Firm*—Samuels, Gauthier & Stevens LLP

[57] ABSTRACT

In a ferrite switchable microwave device, a magnetic structure is formed in a nearly continuous closed-loop configuration of a single crystal material, or of a material exhibiting the magnetic properties of single crystal materials (quasi-single crystal materials). A magnetization M is induced in the structure. The toroidal shape of the structure in combination with the properties of the magnetic material results in a device which exhibits virtually no hysteresis. The device is operable either in a fully magnetized state or in a partially magnetized state. In a fully magnetized state, the device operates in the region of magnetic saturation. The absence of hysteresis in the device enables switching between the positive and negative magnetic saturation points with very little energy. In a partially magnetized state, the device provides a variable magnetization M between the two saturation points. The magnetization curve is made linear and therefore controllable by introducing a gap or other demagnetizing feature in the magnetic structure. This device is particularly operable as a variable phase shifter or tunable filter where the magnetization controls the velocity of electromagnetic energy propagating in the magnetic device.

42 Claims, 9 Drawing Sheets

OTHER PUBLICATIONS

Y.A. Sluzhbin, et al., "Magnetooptical Apparatus for Recording the Hysteresis Loop of Epitaxial Films of Rare–Earth Ferrite Garnets," Donets Physico–Technical Institute, Academy of Sciences of the Ukrainian SSR. Translated from Pribory i Tekhnika Eksperimenta, No. 3, pp. 156–158, May–Jun., 1983. Original article submitted Sep. 28, 1981 (1983).

M. Tsutsumi, et al., "Magnetically Tunable Superconductor Filters Using Yttrium Iron Garnet Films," IEEE Transactions on Magentics, 31(6):3467–3469 (Nov. 1995).

C.D. Mee, "The Physics of Magnetic Recording," IBM Research Center, Yorktown, New York, Fomerly with CBS Laboratories, Stamford, Connecticut, pp. 2–3 (1664).

J.A. Weiss, et al., "The Ring–Network Circulator for Integrated Circuits: Theory and Experiments," IEEE Transactions on Microwave Theory and Techniques, 43(12):2743–2748 (Dec. 1995).

A.G. Glushchenko, et al., "The Use of Thin Single–Crystal Mg–Mn Ferrite Films in Microwave Microstrip Transmission Lines," pp. 106–108 (Jan. 16, 1974).

H.J. Williams, et al., "A Simple Domain Structure in an Iron Crystal Showing a Direct Correlation with the Magnetization," Physical Review, vol. 75(1):178–183 (Jan. 1, 1949).

J.K. Galt, "Motion of a Ferromagnetic Domain Wall in $Fe_3O_4$," Physical Review, vol. 85(4):664–669 (Feb. 15, 1952).

F.B. Hagedorn, et al., "Domain Wall Mobility in Single–Crystal Yittrium Iron Garnet," Journal of Applied Physics, Supplement to vol. 32(3):282S–283S (Mar. 1961).

G.T. Roome, et al., "Session V: Microwave Integrated Circuits," 1968 International Solid–State Circuits Conference, Digest of Technical Papers, ISSCC University Museum/Univ. of Pennsylvania, pp. 52–53 (Feb. 15, 1968).

K.K Chow, et al., "Ferromagnetic Resonance Effects Under Mode–Segregation Conditions," Journal of Applied Physics, vol. 38(3):1411–1412 (Mar. 1, 1967).

V.A. Babko, "Losses During Remagnetization in Single Crystals of Substituted Ferrite Garnets $Y_3Fe_{5-x}Ga_xO_{12}$", pp. 1029–1030, T.G. Shevchenko Kiev State University. Translated from Izvestiya Vysshikh Uchebnykh Zavedenii, Fizika, No. 7, pp. 140–141 (Jul. 1974).-

MAGNETICALLY TUNABLE FERRITE MICROWAVE DEVICES

RELATED APPLICATION

This application is a continuation-in-part of U.S. application Ser. No. 08/738,635 filed on Oct. 29, 1996 of common assignee, now abandoned.

GOVERNMENT SUPPORT

The Government has rights in this invention pursuant to Contract Number F19628-90-C-0002 awarded by the United States Air Force.

BACKGROUND OF THE INVENTION

Ferrites are iron oxides that possess magnetic properties comparable in some respects to the magnetic properties of ferromagnetic metals such as iron, cobalt, and nickel. Although the magnetic strength of ferrites tends to be weaker than that of the ferromagnetic metals, an important and distinguishing feature of ferrites is that they exhibit a dielectric or electrical insulating property. For this reason, ferrites are particularly well suited for applications where electrical conduction is to be avoided, for example in microwave control devices for radar and communication systems.

A ferrite is also a gyrotropic medium that can influence the propagation of an electromagnetic wave or signal. At high frequencies, including the microwave and millimeter-wave bands, a gyromagnetic interaction occurs between the magnetization of the ferrite and the magnetic field component of the electromagnetic wave traversing the ferrite. At a specific frequency that is proportional to the strength of the internal magnetic field, the interaction becomes resonant and the electromagnetic wave is absorbed by the ferrite across a narrow band about the resonance frequency. For microwave frequencies, the applied magnetic field required for resonances is usually greater than 1000 Oe. At frequencies away from the gyromagnetic resonance condition, the absorption becomes negligible but a dispersion effect remains in the wave. This dispersion causes a change in the velocity of propagation that produces phase shift in phase shifters and switchable circulators.

The amount of gyromagnetic interaction is proportional to the magnetization in the ferrite whether at resonance or away from resonance. Magnetization in a conventional polycrystalline ferrite structure exhibits hysteresis. The term hysteresis means that the magnetic state of the ferrite structure is not directly reversible. For this reason, the shape and stability of the hysteresis loop are of critical importance to device performance that depends on a variable magnetization at low magnetic fields.

Polycrystalline materials are dense and comprise many individual crystals usually, but not necessarily, of random crystallographic orientation. Modern polycrystalline microwave magnetic devices are commonly operated in a remanent state and are designed to accommodate the hysteresis loop phenomenon. An initial negative magnetic field pulse drives the device into reverse magnetic saturation and a second positive magnetic field pulse selects an appropriate magnetization level of a minor hysteresis loop such that when the second pulse is removed, the device settles into a desired remanent magnetization.

This technique suffers from several limitations. First, it requires a look-up table to determine an appropriate magnetic field pulse strength to cause the device to settle into a particular magnetization. Because polycrystalline materials are used, these devices suffer from high coercivity and therefore, energy is wasted when switching between magnetization states. In addition, the hysteresis loop is rounded instead of square and therefore, excessive energy is required to reset the device into saturation. Furthermore, the switching time between pulses cannot be reduced below several microseconds without high current drive pulses.

One method for greatly reducing the inefficiencies and uncertainties introduced by the hysteresis loops exhibited by polycrystalline devices is the use of single crystal ferrite structures. A single crystal material has distinct preferred directions of magnetization uniformly throughout the material and exhibits virtually no hysteresis in its magnetization curve. In single crystal devices the magnetization can be crystallographically aligned with the preferred directions, in other words along the "easy" axes, in order to eliminate, or nearly eliminate, the hysteresis loop. This leads to a device which exhibits negligible coercivity and therefore has a magnetization which is nearly directly reversible. For single crystal devices, departure from alignment with the easy axis increases the energy required to magnetize the material. An example of such a configuration, magnetized along the "hard" axis, is given in U.S. Pat. No. 3,257,629, to Kornreich et al.

FIG. 1A illustrates a prior art closed loop magnetic structure 20. Current I flowing through a coil 23 generates a magnetic field which induces a magnetization M in the structure. FIG. 1B illustrates an alternative method for magnetizing an open-loop ferrite structure 25. An external magnet 29 having north N and south S poles, generates a magnetic field 27 which induces a magnetization Min the ferrite structure 25. In FIG. 1C, a coil 30 or solenoid is employed to generate the magnetic field 27. The external magnet techniques of FIGS. 1B and 1C generally require large magnetic fields for inducing or changing the magnetization M of the open loop structures 25 shown, as compared to small magnetic fields for the closed loop structure of FIG. 1A.

Assuming that the structure is formed of polycrystalline material, the structure exhibits a magnetization hysteresis loop as shown in prior art FIG. 1D. The magnetization loop illustrated is magnetization ±M as a function of applied magnetic field ±H between positive and negative saturation levels $\pm M_S$. This hysteresis loop clearly exhibits coercivity which is characterized by the coercive field $H_c$ required for reversing the magnetization of the structure. For this reason, the magnetization of the structure is not directly reversible.

Assuming that the structure is formed of single crystal material cut along the easy axis {100}, the direction of magnetization (M) in the structure of FIG. 1A is uniform along lines 22. At each corner, the magnetization changes direction uniformly along a domain wall 21. Single crystal magnetic devices offer the advantage of negligible coercivity as shown in the magnetization (±M) as a function of applied magnetic field (±H) chart of FIG. 1E. Saturation is illustrated at regions 28B (positive magnetic saturation $M_A$51A) and region 28A (negative magnetic saturation $M_B$51B). Negligible coercivity is exhibited in region 26 between the two saturation points 51A, 51B.

Prior art FIGS. 2A, 2B, and 2C represent single crystal magnetic structures cut along the {100}, {111}, and {110} planes respectively. These devices would exhibit magnetiz curves similar to the curve of FIG. 1C. Note that by convention, when referring to a specific axis, square brackets [. . . ] are used, while a family of axes are referenced using angular brackets <. . . >. Similarly, when referring to a specific plane, parentheses are used ( . . . ), while a family of planes are referenced using braces {. . . }. In FIG. 2A, FIG. 2B, and FIG. 2C, the <100>, <110>, <111>, and <112> designations are standard crystallographic designations for crystals of cubic symmetry, for describing the family of axes of single crystal orientations in space.

Several articles discuss the behavior of hysteresis loops of single crystal magnetic structures:

1) H. J. Williams, et al., "A Simple Domain Structure in an Iron Crystal Showing a Direct Correlation with the Magnetization," *Physical Review*, 75(1):178–183 (January, 1949).
2) J. K. Galt, "Motion of a Ferromagnetic Domain Wall in $Fe_3O_4$", *Physical Review*, 85(4):664–669 (February 1952).
3) F. B. Hagedorn, et al., "Domain Wall Mobility in Single-Crystal Yttrium Iron Garnet", *Journal of Applied Physics, Supplement to* 32(3):282S–283S (March 1961).

These studies are directed to the behavior and speed of regions of reverse magnetization, also referred to as domains, moving through a single crystal structure, and the resulting coercivities of the structure. Coercive fields $H_c$ as low as 0.02 Oe (oersted) with square and stable magnetization curves have been demonstrated in single crystal structures.

An article was published in 1986 related to the elimination of "shearing" effects caused by gaps present in a ferrite toroid:

4) G. F. Dionne, et al., "A Ferrite Bonding Method with Magnetic Continuity", *IEEE Transactions on Magnetics, MAG*-22(5):620–622 (September 1986).

The result is referred to as "hysteresis loop shearing" caused by gap demagnetization. The study investigated a method for reducing the adverse and harmful shearing effects of the air gap created when two separate sections of magnetic material are bonded together to form a magnetic toroid. High permeability iron metal powder is introduced into the gap as a bonding material to reduce the shearing caused by the demagnetizing effects of the gap, resulting in improvement in hysteresis loop squareness.

SUMMARY OF THE INVENTION

The present invention is directed to an apparatus and method for forming electromagnetic devices. The apparatus of the invention comprises a conductor, a magnetic structure, and a circuit for generating a variable magnetization in the structure.

In a first embodiment, the apparatus of the invention comprises a conductor conducting an electromagnetic signal applied thereto. A continuous, closed-loop magnetic structure is disposed sufficiently proximal to the conductor such that the structure interacts gyromagnetically with the structure. A circuit generates a variable magnetic field. The magnetic field is applied to the structure to induce a variable magnetization in the structure. The magnetization varies over a range between the positive and negative magnetization saturation levels for the structure, such that the device operates in a partially magnetized state. By changing the magnetization in the structure, the propagation velocity of the signal is modulated in the region of gyromagnetic interaction, thereby providing phase shift in the signal.

In a preferred embodiment, the magnetic structure is formed of single crystal magnetic material, or alternatively, formed of a magnetic material from a category of materials referred to herein as "quasi-single crystal". Quasi-single crystal materials substantially exhibit the advantageous magnetic properties of single crystal materials magnetized along an easy axis (i.e. high initial permeability (i.e., permeability $\mu'$ value at $H \cong 0$), low coercivity; substantial lack of hysteresis; uniform, reversible magnetization), and are generally more readily available and therefore less expensive than single crystal materials.

In a preferred first embodiment, the closed loop structure further comprises a gap or notch to provide a demagnetization field resulting in a substantially linear relationship between the magnetization and the magnetic field between the two saturation points. For embodiments employing superconductors, the magnetization should be substantially contained within the magnetic structure so as not to interfere with the superconductivity of the conductor. The conductor may be formed as a resonator structure for filter applications or as a meanderline for phase shifter applications.

In a second embodiment, the apparatus of the invention comprises a conductor in the form of a resonator structure having a fixed dimension and a defined fundamental frequency. The conductor conducts an electromagnetic signal applied thereto. A magnetic structure is disposed in sufficient proximity to the conductor so that the signal interacts gyromagnetically with the structure. An electrical circuit generates a variable magnetic field which is applied to the magnetic structure to induce magnetization therein. The magnetization is controlled over a range between the positive and negative magnetization saturation levels for the structure, such that the device operates in the region of partial magnetization. By changing the magnetization in the structure, the propagation velocity of the signal is modulated in the region of gyromagnetic interaction, thereby changing the fundamental frequency of the fixed-dimension resonator structure.

In a preferred second embodiment, the magnetic structure may be formed of polycrystalline, quasi-single crystal, or single crystal material. If single crystal material or quasi-single crystal is used, a nearly closed loop magnetic structure having a demagnetizing gap is preferred. The demagnetizing gap provides a substantially linear relationship between the magnetization and magnetic field in the region of partial magnetization.

In a third embodiment, the apparatus of the invention comprises a conductor conducting an electromagnetic signal applied thereto. A continuous, closed-loop magnetic structure formed of a material having the magnetic properties of a single crystal material, for example a quasi-single crystal material, is disposed sufficiently proximal to the conductor such that the structure interacts gyromagnetically with the structure. A circuit generates a magnetic field. The magnetic field is applied to the structure to induce a magnetization in the structure. The magnetization switches between positive and negative magnetization levels for the structure, such that the device operates as a switch. By changing the magnetization in the structure, the propagation velocity of the signal is altered in the region of gyromagnetic interaction, thereby allowing for phase shift in the signal.

The present invention overcomes the limitations of the prior art techniques described above. High magnetic fields required to produce gyromagnetic resonance are avoided by the use of the partially magnetized state with very small magnetic fields. Reset pulses are not required to switch between magnetization levels, and therefore complex look-up tables, magnetic field pulses, and generating circuitry are not needed. The only energy required is a small amount of holding current to generate the small continuous magnetic field H used to induce the selected magnetization M. In addition, the speed for switching between magnetizations is much faster in the present invention, on the order of tenths of microseconds. This is an order of magnitude faster than conventional polycrystalline ferrite devices and two orders superior to semiconductor or electromechanical switches.

None of the articles referenced above suggest application of single crystal, or quasi-single crystal technology in a partially magnetized state to a microwave device with a closed or nearly closed magnetic structure. Furthermore, the articles fail to suggest or teach intentionally introducing a gap into a toroidal magnetic structure to cause shearing in the magnetization curve such that the magnetization M is variable and selectable with incremental changes in magnetic field H in a partially magnetized magnetic structure. Neither does the prior art suggest that a resonator can be tuned by altering the state of ferrite magnetization regardless of the ferrite physical structure.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts and are not all described in detail throughout the different views. The drawings are not necessarily to scale, emphasis instead being placed upon illustrating the principles of the invention.

DETAILED DESCRIPTION OF PREFERRED EMBODIMENTS

The present invention is directed to an electromagnetic device that employs a magnetic structure suitable for gyromagnetic interaction. The magnetic structure is formed either in a continuous closed-loop configuration, for example in the shape of a toroid or "window-frame", or in an open configuration. A magnetic field H is applied to the structure for inducing a magnetization M therein.

A waveguide, for example a microstrip conductor, is disposed sufficiently proximal to the magnetic structure such that an electromagnetic signal propagating through the waveguide interacts gyromagnetically with the magnetization M of the magnetic structure. The magnetization M of the magnetic structure is selected by adjusting the applied magnetic field H at or between the levels of magnetic saturation. This impacts the propagation velocity of the signal traversing the waveguide. In this manner, the present invention is operable as a switch, phase shifter, circulator, or tunable filter.

The magnetization M of a magnetic structure becomes substantially saturated at a certain level for both positive and negative magnetization orientations. The present invention operates at or between these saturation levels in the region of partial magnetization.

The apparatus of the present invention comprises several embodiments described in detail below. In a first embodiment, a closed-loop magnetic structure exhibiting magnetic properties substantially similar to those of a single-crystal magnetic material (single crystal, quasi-single crystal) operating in the region of partial magnetization influences the propagation velocity of an electromagnetic signal. In a second embodiment, a magnetic structure (closed or open loop, single crystal, quasi-single crystal or polycrystalline) operating in the region of partial magnetization influences the fundamental frequency of a proximal resonator structure, thereby providing a tunable filter. In a third embodiment, a closed-loop magnetic structure exhibiting magnetic properties substantially similar to those of a single-crystal structure (single crystal, quasi-single crystal) operates at the positive and negative thresholds of saturation, such that the device operates as a switch, for example a circulator switch.

Note that for purposes of the present invention, the term "conductor" is defined herein to include a waveguide, a microstrip conductor, a stripline conductor, a wire, a cable, or other media suitable for propagation of an electromagnetic wave signal. Note also that for purposes of the present discussion, the term "single crystal", when used to define a type of magnetic material, includes "quasi-single crystal" materials, which exhibit magnetic properties substantially similar to single crystal devices magnetized along easy axes. The behavior of quasi-single crystal devices are described in detail below.

Figure 3A:
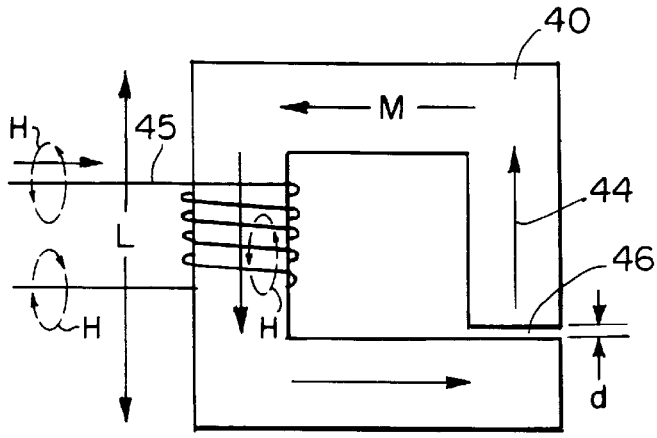
FIG. 3A illustrates a toroidal magnetic structure having a gapped return path for generating a demagnetization field in accordance with the present invention.

In a first preferred embodiment, shown in FIG. 3A, the magnetic structure material 40 comprises single crystal material formed in a nearly closed loop or toroidal structure. The toroidal shape of the magnetic structure 40 in combination with the advantageous magnetic properties of the single crystal material results in a device which exhibits virtually zero coercive field $H_c$, where $H_c$ is the applied magnetic field intensity required to reduce the remanent magnetization M of the device to 0.

The device is operable either in a fully magnetized state or in a partially magnetized state. In a fully magnetized state, the device operates in the regions of magnetic saturation, shown in FIG. 3B as regions I and III, along section 50 of the curve. Low coercive field $H_c$ in the device enables switching between the positive and negative magnetic saturation points, shown in FIG. 3B as points 51A and 51B respectively, with very little energy. A small magnetic field H is continuously applied by a coil 45 (see FIG. 3A) for example to maintain the magnetization M at a suitable level in the region of partial magnetization II (see FIG. 3B) at or between the magnetic saturation levels 51A, 51B. Reversal of the applied magnetic field causes the magnetization to reverse without significant hysteresis effects. One potential application for this embodiment is a circulator switch as described in Weiss et al., "The Ring Network Circulator for Integrated Circuits: Theory and Experiments", *IEEE Trans. Microwave Theory Tech.*, vol. 43, pp. 2743–2748, December 1995.

Figure 3B:
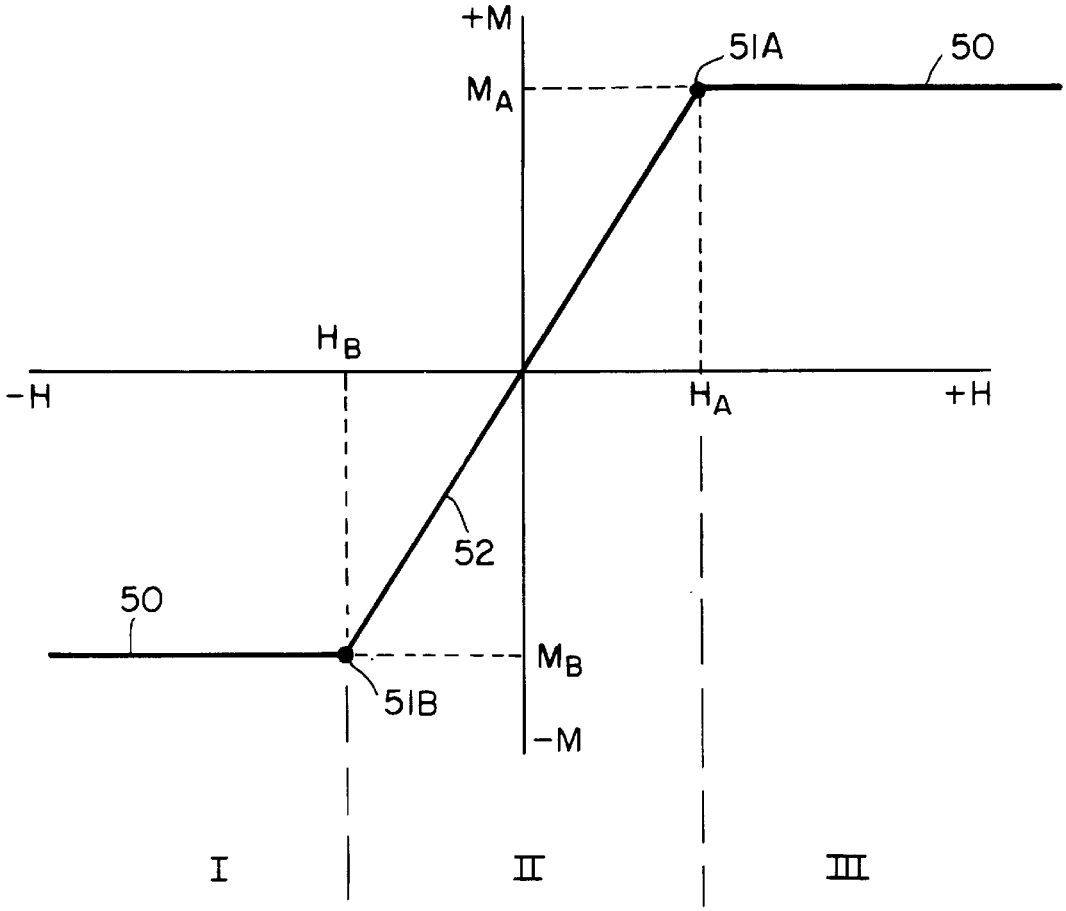
FIG. 3B is a magnetization curve for the structure of FIG. 3A formed of single crystal or quasi-single crystal material in accordance with the present invention.

With reference to FIG. 3B, in a partially magnetized state, the device provides a variable magnetization M between the positive 51A and negative 51B magnetic saturation points in the region of partial magnetization II. A magnetic field H is continuously applied during operation. The applied magnetic field controls the magnitude and direction of the magnetization M. The relationship between the applied magnetic field H and the resultant magnetization M between the two saturation points 51A, 52B can be made substantially linear and therefore controllable by introducing a gapped return path 46 (see FIG. 3A) or non-uniform slotted return path in the toroidal magnetic structure (both hereinafter referred to as a "gap"). The gap causes a "shearing" effect in the magnetization curve of the device, which reduces the slope of the curve 52 (see FIG. 3B) between the saturation points. This slope is also referred to as the D.C. permeability $\mu$. Without the gap 46, it can be difficult to select variable magnetization points between the two saturation points because the slope of the magnetization curve is too steep for single crystal magnetic structures. With the gap, the slope becomes slightly pitched and therefore, magnetization points along the curve 52 are continuously selectable as a function of small increments of magnetic field. With a range of selectable magnetizations M available, this device is particularly operable as a variable phase shifter or as a tunable filter fashioned from a resonator structure conducting an electromagnetic wave that interacts gyromagnetically with the magnetized ferrite.

In a high permeability ferrite structure, the propagation velocity V of the wave is controlled by the value of the ferrite magnetization at small values of magnetic field. At a fixed frequency, the phase shift is proportional to the ratio of the length of the gyromagnetically interacting part of the magnetic structure to the propagation velocity of the electromagnetic wave. For a resonator, the fundamental resonant frequency is equal to the velocity divided by the length of the resonator circuit.

FIG. 3A illustrates a toroidal magnetic structure having a gapped return path in accordance with the above-described first embodiment of the present invention. A magnetic structure 40 is formed in the shape of a toroid as shown. Note that for purposes of the present invention, the term "toroid" when used to describe the shape of magnetic structures, includes any continuous, closed-loop structure within which magnetic flux is substantially confined. A coil 45 generates a magnetic field for inducing magnetization M 44 in the structure as shown.

Figure 1B:
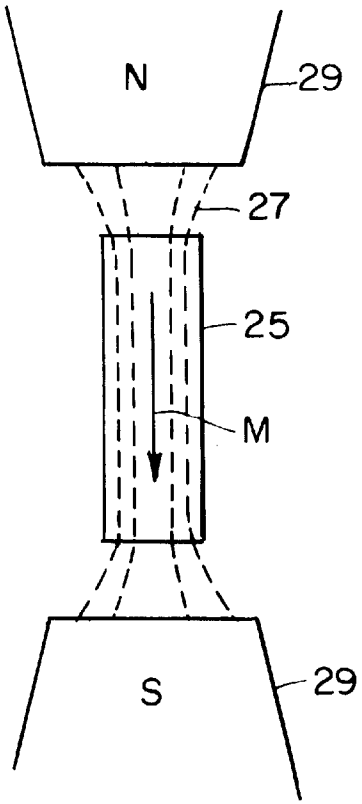
FIG. 1B (Prior Art)
FIGS. 1B and 1C illustrate two common methods for inducing magnetization in an open-loop magnetic structure using external magnetic fields as known in the prior art.
Figure 1A:
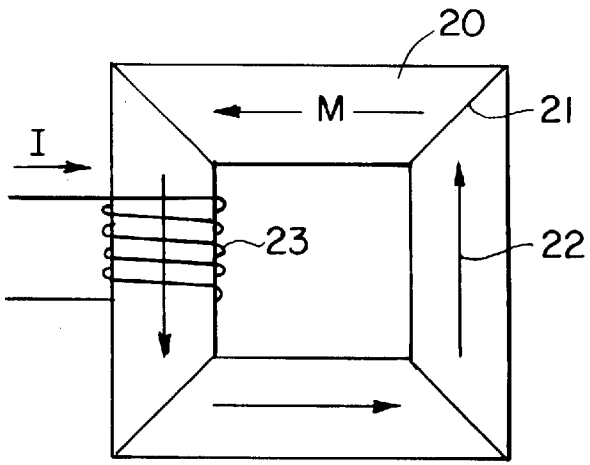
FIG. 1A (Prior Art)
FIG. 1A is a prior art illustration of a toroidal magnetic structure of the prior art.
Figure 1C:
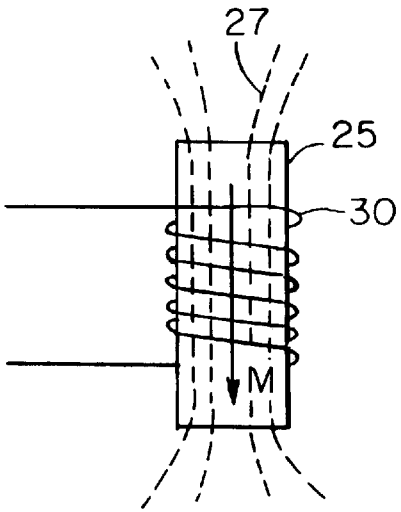
FIG. 1C (Prior Art)
Figure 1D:
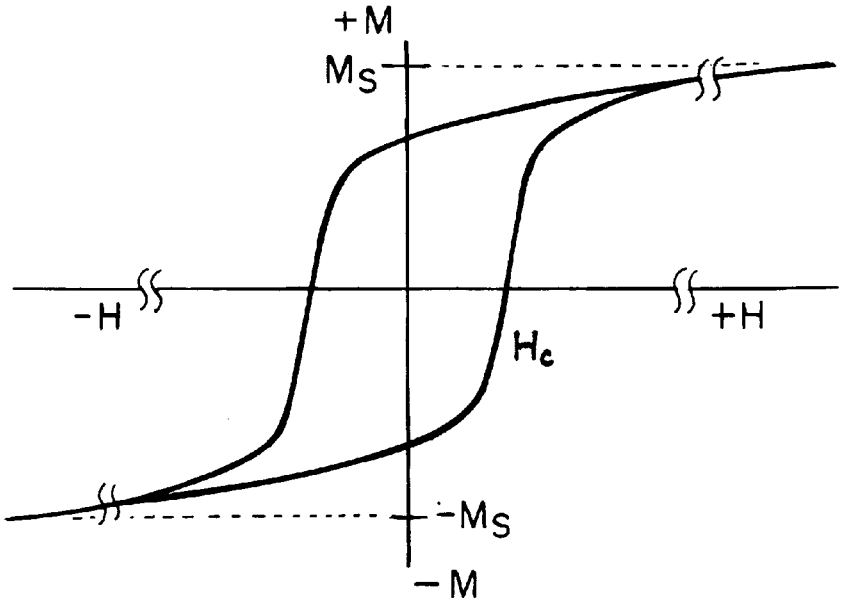
FIG. 1D (Prior Art)
FIGS. 1D and 1E are charts of typical magnetization hysteresis loops for polycrystalline and single crystal structures respectively.
Figure 1E:
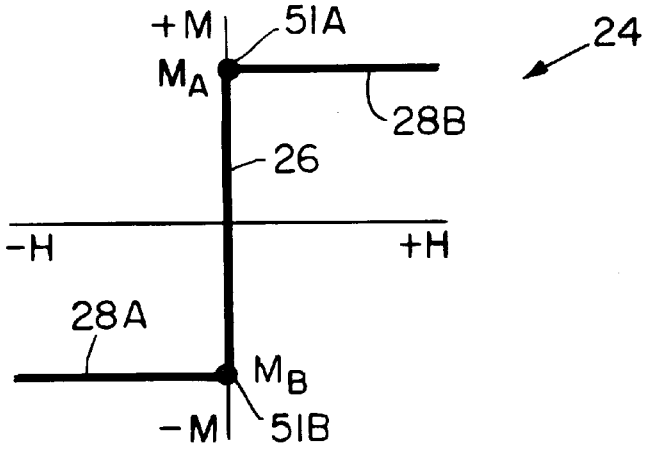
FIG. 1E (Prior Art)

Assuming that the structure is formed of single crystal material, or quasi-single crystal material, the structure would exhibit a magnetization curve as shown in FIG. 1E. This curve demonstrates the nature of signal crystal materials; that is negligible coercivity and negligible shearing in the region 26 of the curve 24 between the two saturation points 51A, 51B, as described above.

By introducing a gap 46 into the toroid 40, a demagnetization zone forms in the magnetic structure. The demagnetization zone causes a "shearing" effect in the magnetization curve 52 by canceling part of the applied magnetic field, as shown in the chart of FIG. 3B. As can be seen in FIG. 3B, the magnetization curve for the gapped magnetic structure 52 demonstrates a sloped relationship between the magnetic field ±H and the magnetization ±M as compared to the square relationship shown in FIG. 1E for the continuously toroidal magnetic structure. It can clearly be seen in the respective magnetization curves of FIGS. 3B and 1E, that selection of magnetizations along the square curve 26 of FIG. 1E resulting from the closed-loop structure requires greater precision in applied magnetic field H when compared to the sheared magnetization curve 52 of FIG. 3B. For example, if an application of the device required that the magnetization M be switched from magnetization $M_A$ 51A to magnetization $M_B$ 51B, then in the square magnetization curve 26, it appears that the magnetic field H required to induce magnetization $M_A$ is almost identical to the magnetic field H required to induce magnetization $M_B$. For this reason, greater precision is required in generating the magnetic field H. In contrast, along the sheared magnetic curve 52 of FIG. 3B, resulting from the gapped 46 magnetic structure 40 of FIG. 3A, it can be seen that the transition from magnetization $M_A$ to magnetization $M_B$ covers a wider range of magnetic fields H and therefore less precision is required to induce the transition.

In this manner, by introducing a gap 46 in the single crystal, or quasi-single crystal toroidal structure, an intentional slope is introduced in the curve such that the magnetizations Mare selectable as a linear function of incremental amounts of magnetic field H. The slope is characterized by the ratio of the length of the magnetic path to the width of the gap. For example, the slope of the magnetization curve of FIG. 3B in the partially magnetized region II is characterized by 4L/d where L is the length of one side of the structure of FIG. 3A and d is the width of the gap as seen in FIG. 3A.

Assuming that the magnetic structure 40 is formed of single crystal material, and assuming that the structure is substantially closed loop with a demagnetization zone gap 46, the structure would exhibit a magnetization curve as shown in FIG. 3B, as described above. The curve of FIG. 3B demonstrates negligible coercivity, a direct advantage of using single crystal material. With negligible coercivity, only a small amount of power is required to reverse the magnetization of the structure. For example, if the desired magnetic field of the structure was to be reversed from magnetization $M_A$ to magnetization $M_B$, then the magnetic field only needs to be adjusted from $H_A$ to $H_B$, representing a small amount of change in magnetic field requiring only a small amount of power, leading to a more efficient design.

With negligible coercivity in the magnetization curve, the single-crystal gapped magnetic structure of the present invention would not be effected to operate in a remanent state. That is, to ensure a particular magnetization in the structure, a corresponding magnetic field is continuously applied. This is referred to herein as a holding current I applied to the coil 45 (as seen in FIG. 3A), for generating the small magnetic field. If the small magnetic field is removed, the magnetization becomes close to zero because of the absence of hysteresis and remanence.

At first glance it may appear that operating without hysteresis with a continuous magnetic field would require more energy than operating in a remanent state. Actually, the reverse is true as the remanent devices of the prior art require large amounts of energy in applying a reset pulse for driving the device into magnetic saturation, followed by another pulse for selecting the remanent magnetization of an unsaturated, or minor hysteresis loop.

Figure 4A:
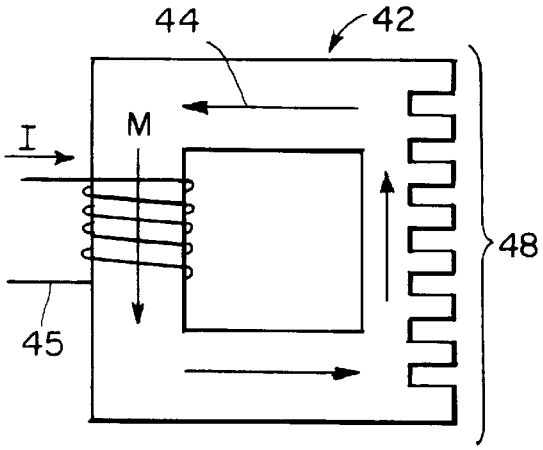
FIGS. 4A and 4B illustrate alternative methods for creating demagnetization fields for introducing shearing in the hysteresis loop of magnetic structures in accordance with the present invention.
Figure 4B:
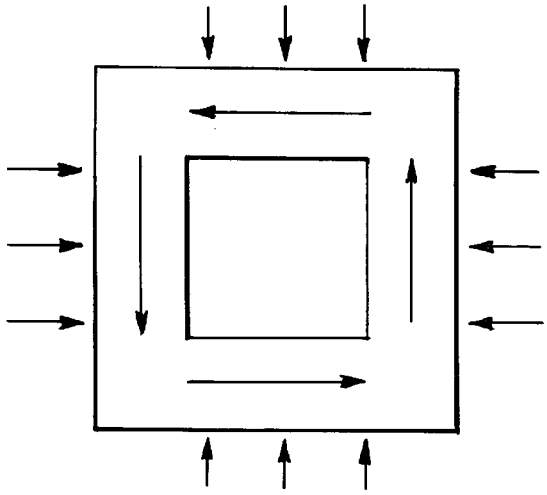

FIGS. 4A and 4B illustrate alternative methods for inducing a demagnetizing effect in a closed-loop magnetic structure, resulting in magnetization curve shear. In FIG. 4A, slots 48 are introduced in a side of the window-frame toroid 42. The dimensions of the slots can be adjusted to shear the magnetization curve as shown in FIG. 3B. Stress imposed on the structure as shown (by the short inwardly directed arrows) in FIG. 4B can also be employed to cause shearing as described above.

For devices with high-temperature superconductor circuits, the use of single crystal ferrites greatly simplifies the layered configuration necessary to bring the superconductor in contact with the ferrite for optimal gyromagnetic interaction. In addition, the use of single crystal materials in selected crystallographic orientations dramatically reduces the stress sensitivity of the hysteresis loops, a nagging problem with polycrystalline ferrites.

Figure 5A:
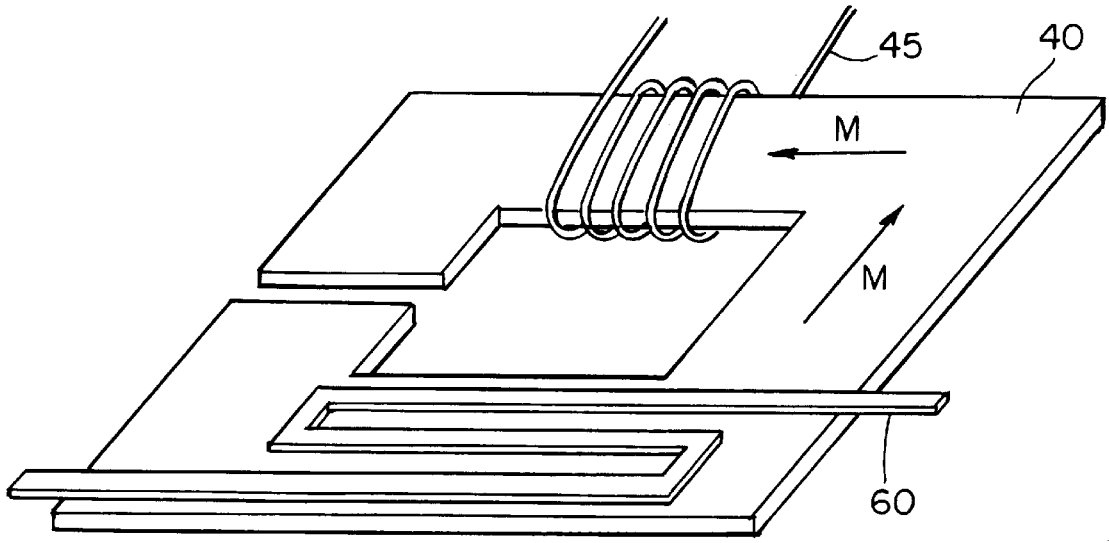
FIG. 5A illustrates a switchable non-reciprocal phase shifter having a meanderline circuit and circular polarization in accordance with the present invention.
Figure 5B:
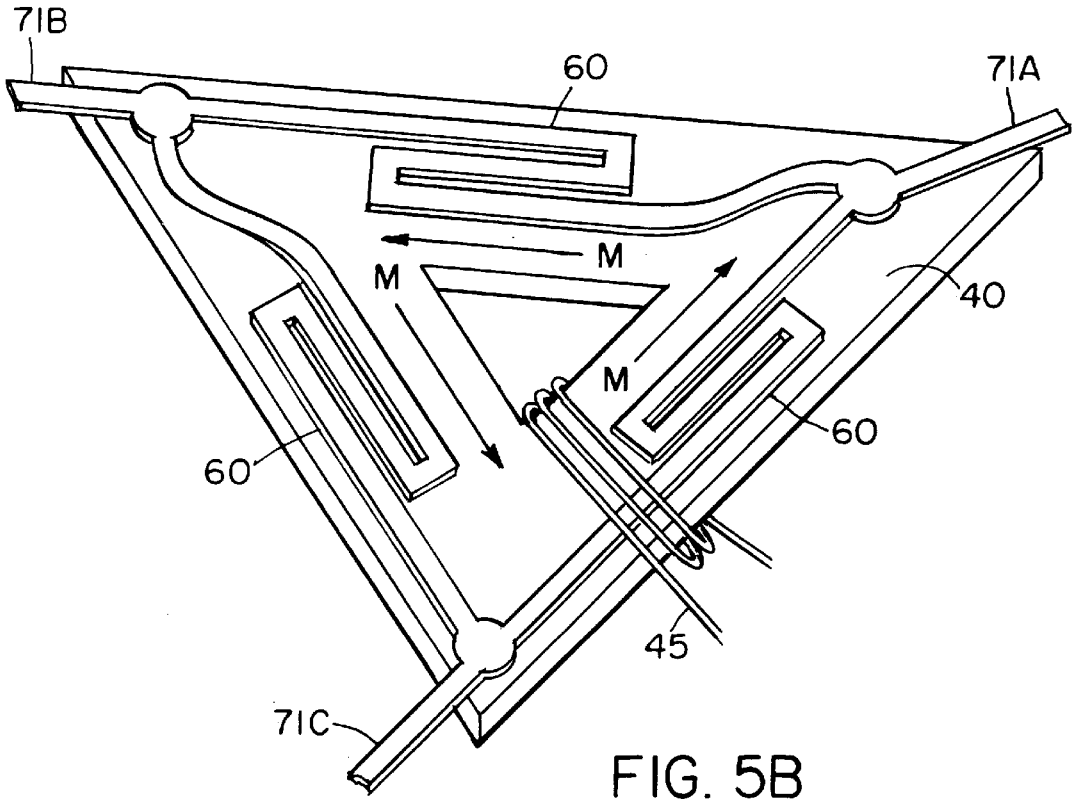
FIG. 5B illustrates a circulator formed of three meanderline circuits in accordance with the present invention.

FIGS. 5A and 5B illustrate alternative applications of the first embodiment of the present invention. In FIG. 5A, a closed loop magnetic structure 40 formed of single crystal material is disposed proximal to a conductor 60. The conductor 60 is in the shape of a meanderline as shown to cause phase shift in an electromagnetic signal traversing the conductor 60. The phase shift is caused by virtue of gyromagnetic interaction between the electromagnetic energy traversing the conductor and the magnetization in the ferrite magnetic structure.

Figure 2A:
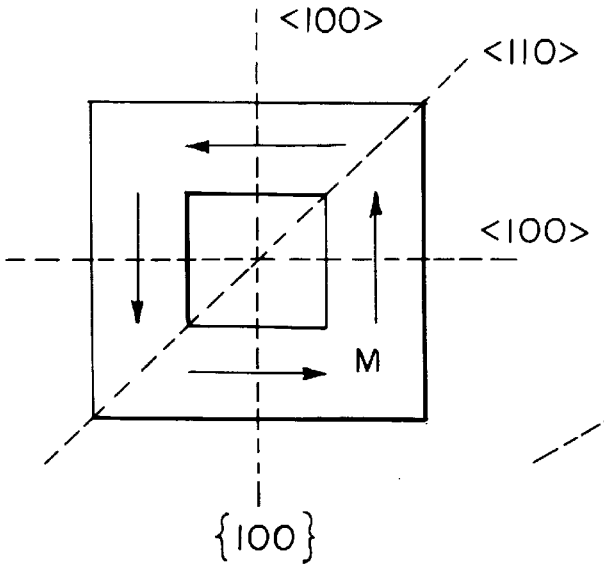
FIG. 2A (Prior Art)
FIGS. 2A, 2B, 2C represent single crystal or quasi-single crystal devices cut in the {100}, {111}, and {110 } planes respectively in accordance with the prior art.
Figure 2B:
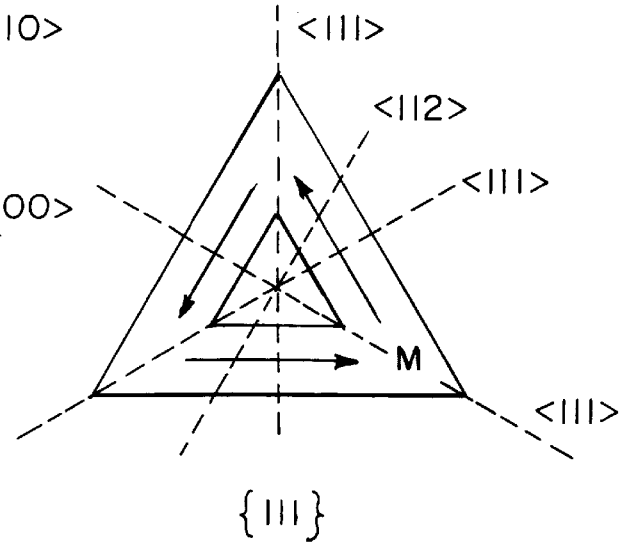
FIG. 2B (Prior Art)
Figure 2C:
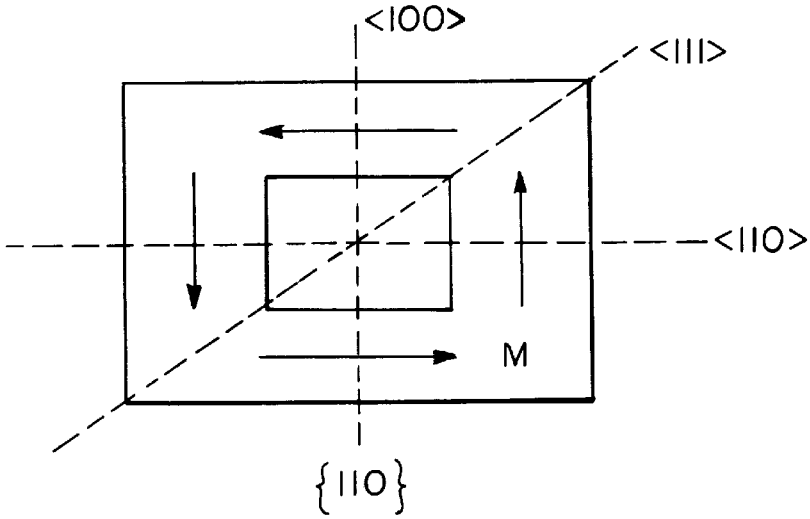
FIG. 2C (Prior Art)

In FIG. 5B, the single crystal material 40 is cut along easy axis {111} as shown in FIG. 2B, and the conductor 60 comprises three meanderlines 60 forming a three port ring network circulator as described in U.S. Pat. No. 3,304,519 and U.S. Pat. No. 5,608,361, the contents of both being incorporated herein by reference. Coil 45 generates a magnetic field, inducing magnetization M in the structure. The magnetization M interacts gyromagnetically with signals traversing the conductor 60 to give a circulation effect between adjacent ports 71A, 71B, 71C. The direction of circulation depends upon the orientation of the magnetization M in the structure 40. A holding current in the coil 45 sustains the magnetization M at a suitable level between or near the saturation levels 51A, 51B (see FIG. 3B) of the magnetic structure. By reversing the holding current, the magnetization of the structure 40 is reversed, thereby reversing the circulation condition. This embodiment is also applicable as an electromagnetic switch.

In a second preferred embodiment, the present invention comprises a tunable filter. A waveguide or microstrip conductor disposed proximal to a magnetic structure conducts an electromagnetic signal. The conductor, termed a resonator, has physical boundaries such that the signal resonates between them at a fundamental frequency that is proportional to the propagation velocity of the signal interacting gyromagnetically with the magnetic structure. The velocity is controlled by the magnetization of the structure which determines the extent of gyromagnetic interaction between the structure and signal, thereby providing for tunability. The filter device of the present invention can be formed of polycrystalline, single crystal, or quasi-single crystal material, preferably, but not necessarily in a closed magnetic structure.

If a single crystal, or quasi-single crystal ferrite structure is employed, the structure is preferably formed in the shape of a toroid, as described above. A gap is introduced in the structure to shear the magnetization curve, thereby allowing for variable control over the magnetization of the structure as a function of applied magnetic field, as described above.

Tunable filter embodiments are illustrated in FIGS. 6A–6D. In each embodiment, a coil 45 magnetizes the structure 75, inducing a magnetization M therein in the direction shown. A conductor 73 proximal to the magnetic structure 73 conducts an electromagnetic signal which interacts gyromagnetically with the magnetization of the magnetic structure 75 as described above.

A resonator structure 74 forms part of the conductor 73. The resonator 74 has a defined fundamental frequency which is a function of the dimensions of the resonator 74. The gyromagnetic interaction 77 (see FIGS. 6A, 6B) between the resonating signal and the magnetization M in the magnetic structure 75 changes the propagation velocity of the signal in the region of gyromagnetic interaction. This, in turn, changes the fundamental frequency of the structure. In this manner, adjusting the magnetization of the partially magnetized structure between the magnetic saturation points allows for tuning of the fundamental frequency of the resonator, providing the basis for a tunable filter.

Figure 6A:
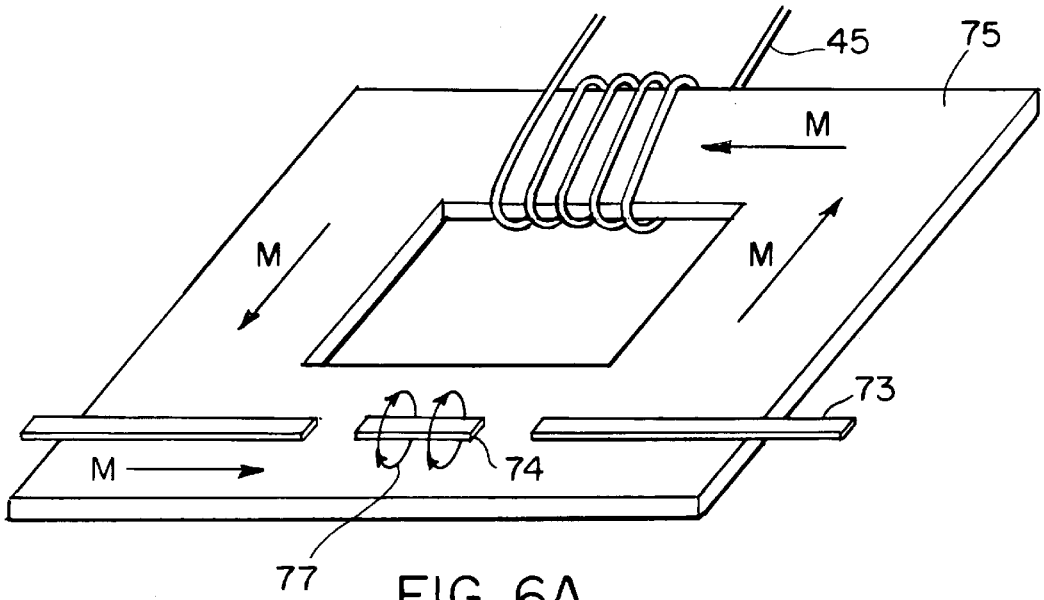
FIG. 6A illustrates a resonator which may be converted into a tunable filter having a closed-loop magnetic structure in accordance with the present invention.
Figure 6B:
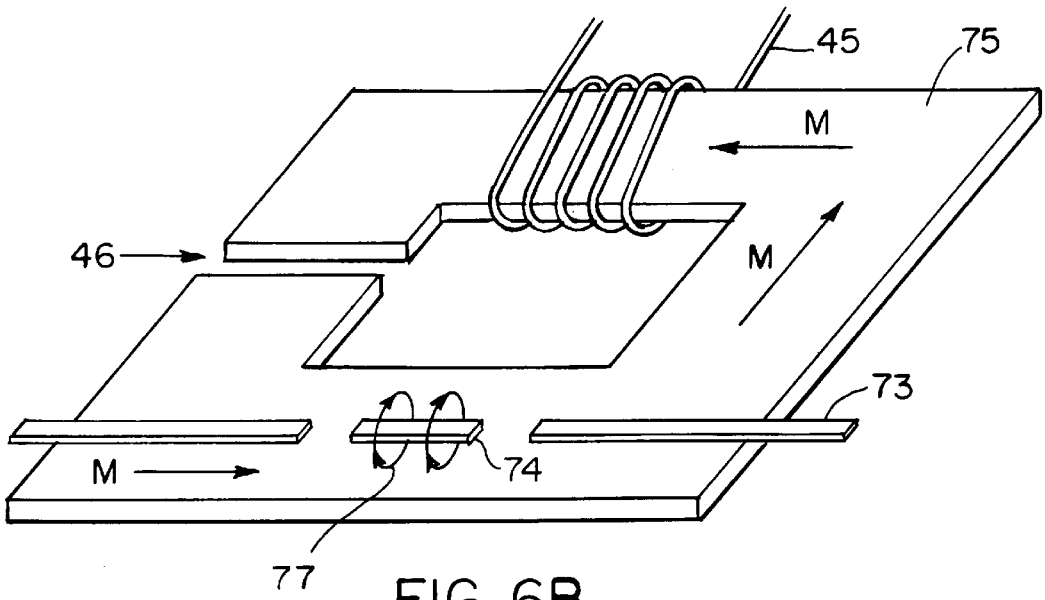
FIG. 6B illustrates a tunable filter having a gap in the return path for forming a demagnetization zone in accordance with the present invention.
Figure 6C:
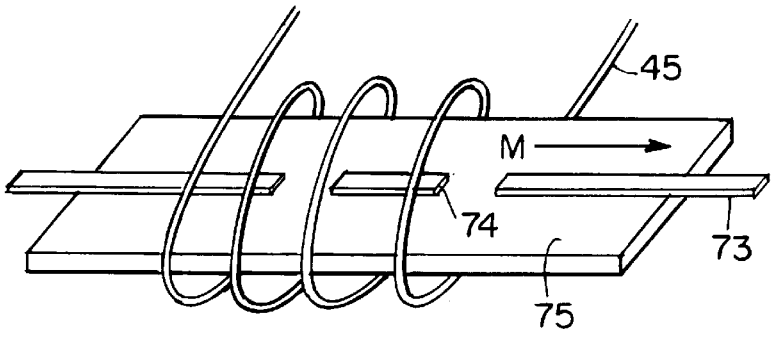
FIG. 6C illustrates a tunable filter having open-loop magnetic structure in accordance with the present invention.
Figure 6D:
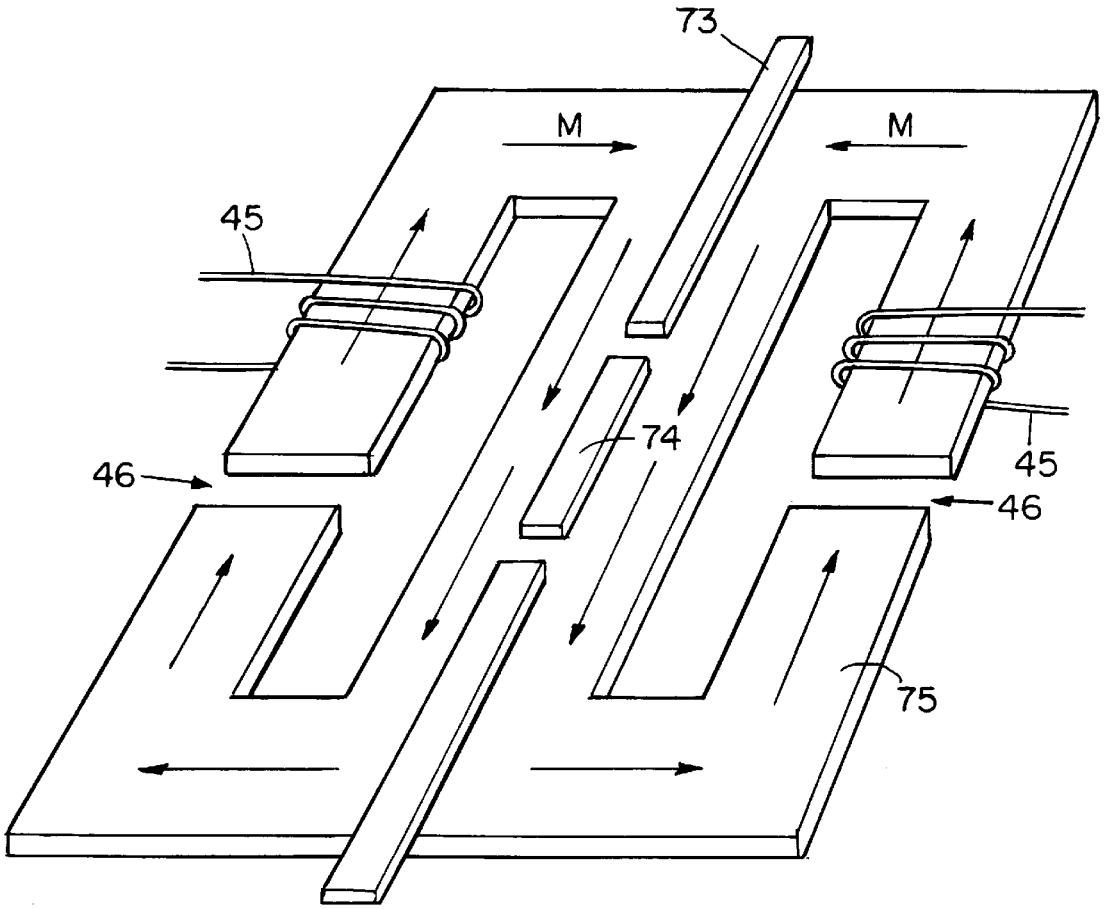
FIG. 6D illustrates a tunable filter having dual return paths and dual gaps in accordance with the present invention.

The closed-loop structure 75 of FIG. 6A is well-suited for polycrystalline magnetic materials. In FIG. 6B, a gap 46 is introduced in the structure. This embodiment is useful with single-crystal magnetic materials because the gap 46 provides a demagnetization effect for shearing the magnetization curve, allowing for tunability between the saturation levels, as described above. In FIG. 6C, an open-loop structure is employed, analogous to an infinite gap. In FIG. 6D, a structure having dual-gapped return paths is shown. This embodiment exhibits a more uniform, symmetric magnetization in the region of gyromagnetic interaction.

Ferrite magnetic structures are also referred to as ferrimagnetic media. Dispersive effects on electromagnetic signals, for example r.f. waves, in ferrimagnetic media are caused by gyromagnetic interactions. From the classical analysis of a magnetic moment (or magnetization) M processing about a magnetic field vector H, relations for the complex r.f. permeability $\mu=\mu'-j\mu''$ where $\mu''$ is the real component of the complex component can be determined for the two counter-rotating (±) modes of circular polarization. Permeability is the ratio of the induced magnetization M to the magnetic field in a given magnetic structure. The permeability relations, derived in B. Lax and K. J. Button, "Microwave Ferrites and Ferrimagnetics", (McGraw Hill, New York 1962) p. 156, are as follows for a wave propagating in the z-direction of a body magnetized in the z-direction:

$$\mu'_{\pm} = 1 + \left[\frac{\gamma 4\pi M(\nu_r \mp \nu)}{(\nu_r \mp \nu)^2 + (\Delta\nu)^2}\right], \tag{1}$$

$$\mu''_{\pm} = \left[\frac{\gamma 4\pi M \Delta\nu}{(\nu_r \mp \nu)^2 + (\Delta\nu)^2}\right], \tag{2}$$

where $\nu_r \approx \gamma\{[H+(N_y-N_z)4\pi M]\,[H+(N_x-N_z)4\pi M]\}^{1/2}$ is the value of frequency $\nu$ at ferrimagnetic resonance (FMR), $\Delta\nu$ is the FMR resonance half-linewidth, $\gamma$=2.8 MHz/kOe is the gyromagnetic constant, $0 \leqq N_x, N_y, N_z \leqq 1$ are the demagnetizing factors along the respective directions, and H is the externally applied magnetic field.

For structures where $\Delta\nu$ is small, Equations 1 and 2 simplify to:

$$\mu'_{\pm} = 1 + \frac{\gamma 4\pi M}{\nu_r \mp \nu} \tag{3}$$

$$\mu''_{\pm} = \frac{\gamma 4\pi M \Delta\nu}{(\nu_r \mp \nu)^2} \tag{4}$$

The basic principle on which ferrite electromagnetic devices operate is the control of the electromagnetic propagation velocity $V_{\pm}$ which is proportional to $(\mu_{\pm})^{-1/2}$ and the power loss which is proportional to $\mu_{\pm}''$. The magnetic loss property of the ferrite is generally characterized by tan $\delta_m = \mu_{\pm}''/\mu_{\pm}'$.

From Equation 3 it can be seen that there are two methods for controlling the propagation velocity $V_{\pm}$ at a given frequency $\nu$. In a first method, the magnetization is at saturation ($4\pi M_s$) and the ferrimagnetic resonance frequency $\nu_r$, can be varied by adjusting the magnetic field H. Although this method can lead to greater tunability near resonance where $\nu_r \approx \nu$, this method usually requires a large external magnetic field. If a superconductor waveguide is used, the large external magnetic field would adversely affect the superconductivity of the waveguide, as described in U.S. Pat. No. 5,484,765, incorporated herein by reference.

In a second method for controlling the propagation velocity $V_{\pm}$, the magnetization variable $\gamma 4\pi M$ is adjusted in the range between the two saturation limits $\pm 4\pi M_s$. In this method, a magnetic field sufficient to produce saturation is all that is needed. In this case, the tuning is achieved by means of the partially magnetized state of the magnetic structure.

For devices which operate in a partially magnetized state with the flux confined to a closed path ($\nu_r << \nu$), relations for nonreciprocal differential phase shift per unit length, $\Delta\Phi = \Phi_+ - \Phi_-$ and magnetic loss property tan $\delta_m$, may be approximated from Equations 5 and 6: where $\Phi_+$ and $\Phi_-$ represent the phase angles for a plane wave of positive and negative circular polarization respectively, $$|\Delta\phi| \propto \nu(\mu^{+1/2} - \mu^{-1/2}) \tag{5}$$

or $$|\Delta\phi| \propto \gamma 4\pi M$$

and $$\tan\delta_m \approx \frac{\gamma 4\pi M}{\nu}\frac{\Delta\nu}{\nu}, \tag{6}$$

where $\mu_{\pm}$ is assumed to be $\cong 1$.

The resonance frequency $\nu_0$ of a demagnetized ($4\pi M=0$) resonator of fixed length is given by the ratio of the demagnetization propagation velocity $V_0$ to the physical length of the resonator. Since the length of the resonator is fixed, the resonator frequency $\mu_{\pm}$ scales directly with the propagation velocity $V_{\pm}$, which is proportional to $\mu_{\pm}^{-1/2}$. If the limit of $\gamma 4\pi M << \nu$, then $$\nu_{\pm} = \nu_0 \mu_{\pm}^{-1/2} \simeq \nu_0\left(1 \mp \frac{\gamma 4\pi M}{\nu}\right)^{-1/2} \tag{7}$$

where each sense of circular polarization, if preserved upon reflection, would cause separate resonator frequencies; a first resonance above, and a second below, $\nu_0$ by an amount $|\nu_{\pm} - \nu_0|$. One application embodied by the novel concept of the present invention is a resonator of frequency $\nu_0$ that is made tunable by controlling the propagation velocity of a linearly polarized wave through variation of the magnetization between 0 and its saturation value $4\pi M_s$.

For a wave linearly polarized along the x-axis and propagating longitudinally in the z-direction of $4\pi M$ under these same conditions there is a single value of $\nu$ because the effective permeability is an average of the two circular polarization modes (see Lax and Button, cited above, p. 159):

$$\mu'_{eff} = 1 - \frac{\gamma 4\pi M}{\nu}\left(\frac{\gamma[H + (N_y - N_z)4\pi M]}{\nu}\right) \tag{8}$$

where $N_z$ is a small geometric demagnetizing factor along the z direction and $N_y$ in this case is the demagnetizing factor from the r.f. magnetization induced by the magnetic field of the r.f signal along the x-axis, and $$\tan\delta_m \approx \mu''_{eff} \approx \frac{\gamma 4\pi M}{\nu}\frac{\Delta\nu}{\nu} \tag{9}$$

The frequency of a resonator that operates with linear polarization is approximated from Equation 8 as:

$$\nu = \nu_0 \mu'_{eff} - 1/2 = \nu_0\left\{1 + \frac{\gamma 4\pi M}{\nu_0}\left(\frac{\gamma[H + (N_y - N_z)4\pi M]}{\nu_0}\right)\right\}^{-1/2} \tag{10}$$

Inspection of Equation 10 reveals that the key to the tunability at magnetic fields $H \cong 0$ is a value of $N_y$ approaching unity, which is difficult to achieve in planar structures. For filter operation where a single value of velocity V is required for the resonance condition, the polarization, whether circular or linear must be preserved upon reflection at the boundaries of the resonant structure. It should be pointed out that circular polarization with a single-valued velocity of propagation V could provide potentially greater tunability than that of the linear case.

Figure 7:
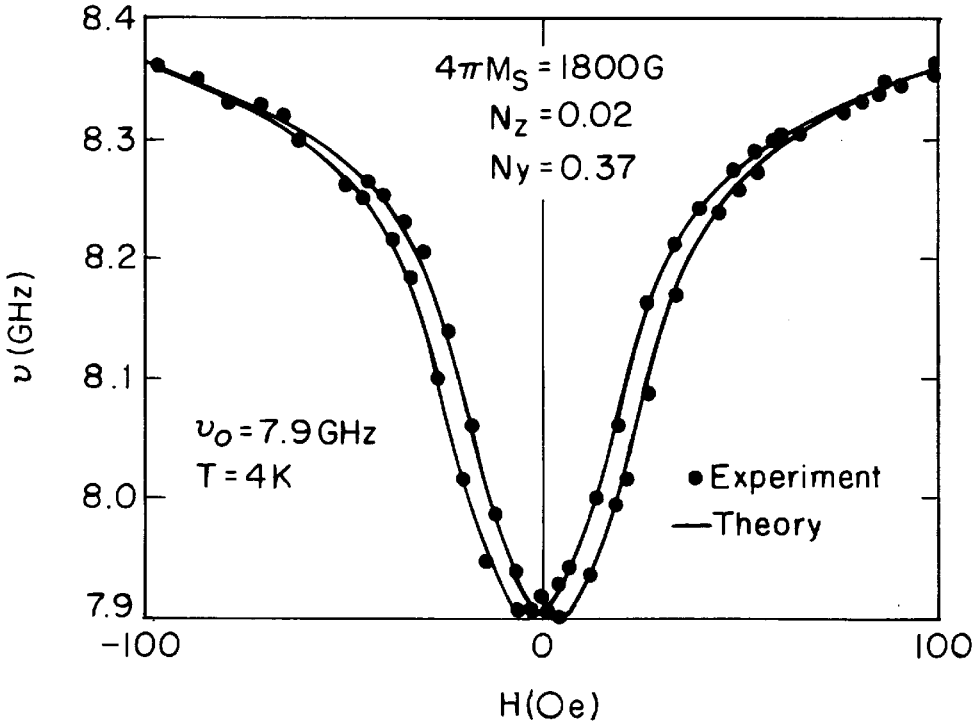
FIG. 7 is a chart representing frequency in GHz as a function of applied magnetic field illustrating tunability in the region of partial magnetization for an experimental embodiment.

FIG. 7 is a plot of the measured frequency $\nu$(GHz) versus magnetic field dependence H(Oe) of a resonator comprising a niobium superconductor on a polycrystalline magnetic garnet substrate, placed in a uniform magnetic field. The experimental results are compared to an analytical model of the magnetization curve for a magnetic structure in the partially magnetized state. For an effective demagnetizing factor of $N_y \approx 0.37$ and $N_z \approx 0.02$, and a saturation magnetization $4\pi M_s$ of 1800 G, a center frequency $\nu_0$ of 7.9 GHz and a temperature T=4 K, the computed results indicate that the measured frequency $\nu$ closely follows the state of magnetization on the hysteresis loop, as predicted by Equation 10. A theoretical estimate for typical X-band operation in the partially magnetized state would place a practical upper limit on the ratio of $\nu/\nu_0$ at about 1.1, which corresponds to a tunability range of 10%. Because this design is readily compatible with superconductor circuitry if the dc flux is confined to a closed magnetic path, microwave efficiency will be contingent on the intrinsic magnetic loss property tan $\delta_m$ of the ferrite, which can be made less than $10^{-4}$ with proper choice of chemical constituents.

A design objective would be to employ the ferrite with the largest practical magnetization $4\pi M$ and the narrowest linewidth $\Delta\nu$, and to choose a geometry with the largest effective demagnetizing factor along the y-axis $N_y$, which in the planar microstrip case arises from magnetic poles that appear on either side of the linear circuit where the r.f. magnetic field lines enter and emerge from the surface of the ferrite.

Traditionally, the ferrites used in these devices are polycrystalline, comprising many tiny crystallites randomly oriented. The lack of specific orientation causes an averaging of many magnetic parameters that are treated as isotropic in device design. Consequently, the parameters most affected are those with anisotropic values magnetocrystalline anisotropy and magnetostriction. In practical terms, this means that the minimum ferrimagnetic resonance (FMR) linewidth $\Delta\nu$ could only assume its intrinsic values far out into the wings of the FMR resonance line. For most devices, this inhomogeneous line broadening is relatively unimportant because the operation frequency is far from the FMR condition.

For switching applications, however, the design of the hysteresis loop ($4\pi M$ versus H) is of critical importance. The key features of the ferrite hysteresis loop illustrated above are its remanence ratio R (the ratio of the magnetization at H=0 to the saturation magnetization, $4\pi M_r/4\pi M_s$), and its coercive field $H_c$ which should be as small as possible to ensure low switching energies and switching times, while maintaining high remanence ratios. Selected states of $4\pi M$ in polycrystalline materials are established through the use of energy pulses to generate controlled amounts of magnetic flux reversal as disclosed in W. J. Ince and D. H. Temme, *Advances in Microwaves* 4, 1 (1969).

The total switching energy $E_{SW}$, not including that of the drive circuit, is essentially the area of the hysteresis loop, $$E_{SW} \approx 2H_c(4\pi M_r) \tag{11}$$

An additional problem concerns the stability of the remanence ratio, which is dependent on the ratio of stress-induced magnetostrictive energy ($E_\sigma$) to the magnetocrystalline anisotropy energy ($E_K$), $|E_\sigma/E_K|$. *If EK* is minimized by chemical substitution in order to reduce $H_c$, which will be necessary for low temperatures applications, $|E_\sigma/E_K|$ could increase sharply and cause a severe deterioration in remanence ratio R. As a result, independent compensation of $E_\sigma$ may be necessary to obtain the best switching performance of the ferrites.

For applications that require changing of the magnetic state, the limitations of polycrystalline materials are substantial. In particular, the magnetic "domains" which are regions of uniformly magnetized material separated by domain walls, usually designated as 180-degree and 90-degree depending on the relative directions of the magnetization vectors on either side of the wall, are influenced by the random orientations of the crystallites or grains and form a mosaic pattern with random directions of the individual domain $4\pi M$ vectors about the average magnetization direction. The net magnetization then becomes an average or mean $4\pi M$ that reaches typically about 70% of the saturation value in the remanent state, i.e., R=0.7. In applications where rapid switching of the state of magnetization must occur, the coercive field $H_c$ is important because it determines not only the amount of energy expended during the switching operation, but also the speed of switching.

With a single crystal magnetized along its easy direction of magnetization, the magnetic state may be set directly without the concerns of irreversibility caused by hysteresis. There is virtually no width to the loop, and the remanence ratio is essentially 1.0 along an easy direction of magnetization. Moreover, the stress sensitivity of the remanent magnetization that can be so detrimental in polycrystalline ferrites could be reduced dramatically by careful selection to the crystallographic orientation relative to the direction of magnetization.

Examples of magnetic polycrystalline or single crystal materials include: yttrium-iron-garnet; nickel-spinel-ferrite; lithium-spinel-ferrite; magnesium-manganese-spinel-ferrite families.

While this invention has been particularly shown and described with references to preferred embodiments thereof, it will be understood by those skilled in the art that various changes in form and detail may be made therein without departing from the spirit and scope of the invention as defined by the appended claims.

Although the above discussion refers to single crystal materials as providing the preferred hysteresis loop configurations, a family of materials, referred to herein as "quasi-single crystal" materials, are equally applicable to the present invention. Quasi-single crystal materials substantially exhibit the advantageous magnetic properties of single crystal materials (i.e., high initial permeability, low coercivity; substantial lack of hysteresis; uniform, reversible magnetization), and are generally more readily available and therefore less expensive than single crystal materials.

A single-crystal magnet features magnetization properties that mirror the structure of its ionic lattice. In a typical compound the symmetry axes of the crystal lattice dictate a pattern of easy (favored) directions of magnetization that alternate between hard (unfavored) magnetic directions. This property of favored magnetization directions is termed magnetocrystalline anisotropy and the energy required to rotate the magnetization vector M from an easy to a hard direction is characterized by the magnetocrystalline energy density parameter $K_l$. The magnetic field required to overcome this rotational energy and rotate the M vector into its saturation direction is called the anisotropy field, which is proportional to $K_l/M_s$. Logically, it follows that the magnetization of a single crystal without energy expense would require a geometric design of the magnetic structure that would place the magnetic flux paths always along easy directions. The magnetization as a function of applied magnetic field would ideally be a vertical line reaching to the saturation value and then continuing horizontal at that level for increases in magnetic field. There would also be no hysteretic properties, as the process would be completely reversible.

On the contrary, a polycrystalline magnet is a conglomerate of individual single crystals, called grains, with magnetization properties that reflect an average of the properties of the grains with random crystallographic orientation in most cases. Because of the randomness on the grain orientations, the effects of the anisotropy energy become averaged over the material and cause an effective isotropic rotational energy proportional to $K_l$ when expressed in terms of magnetic field strength. This means that, regardless of direction, a magnetic field of that magnitude is required to bring the material to a magnetically saturated state. A second important feature of a polycrystalline material results from the presence of nonmagnetic regions, e.g., air pores, and boundaries between grains that represent magnetic discontinuities in the bulk material. These imperfections serve as pinning centers for magnetic domain walls that must move during switching. Because of this additional force required to move the domains in the presence of pinning centers, the material is able to remain magnetized when the applied field is removed. As a consequence, the process is irreversible and the magnetization curve becomes an open hysteresis loop. The field required to overcome the domain wall pinning and demagnetize the material is the coercive filed $H_c$, which is related by $$H_c \sim [(K_l)^{1/2}/M_s](p/d) \quad (12)$$

where p is the fractional porosity and d is the average grain dimension. As seen in Equation 12, the anistropy parameter of the single crystal $K_l$, also contributes to the width of the hysteresis loop, because it determines the magnitude of the domain wall surface energy.

From the above discussion, it is possible to propose the creation of a quasi-single crystal magnet, i.e., a polycrystalline material with hysteresis properties substantially approaching those of a single crystal, provided that two conditions are satisfied:

First, the chemical compound should be designed to render $K_l \cong 0$. Such modification can be achieved by select chemical substitutions, e.g., cobalt in place of iron in spinel or garnet ferrite, and indium, scandium, vanadium, or zirconium in place of iron in garnet ferrites.

Second, the polycrystalline body should be densified to reduce domain wall pinning centers (porosity) and grain boundaries. This can be accomplished by standard hot pressing ceramic techniques or by a number of modern film deposition methods such as sputtering, pulsed-laser ablation (PLD) or metal-organic chemical vapor depression (MOCVD). Grain growth can be accomplished by host-deposited annealing. Where possible, the individual grains should align along easy axes.

Figure 8:
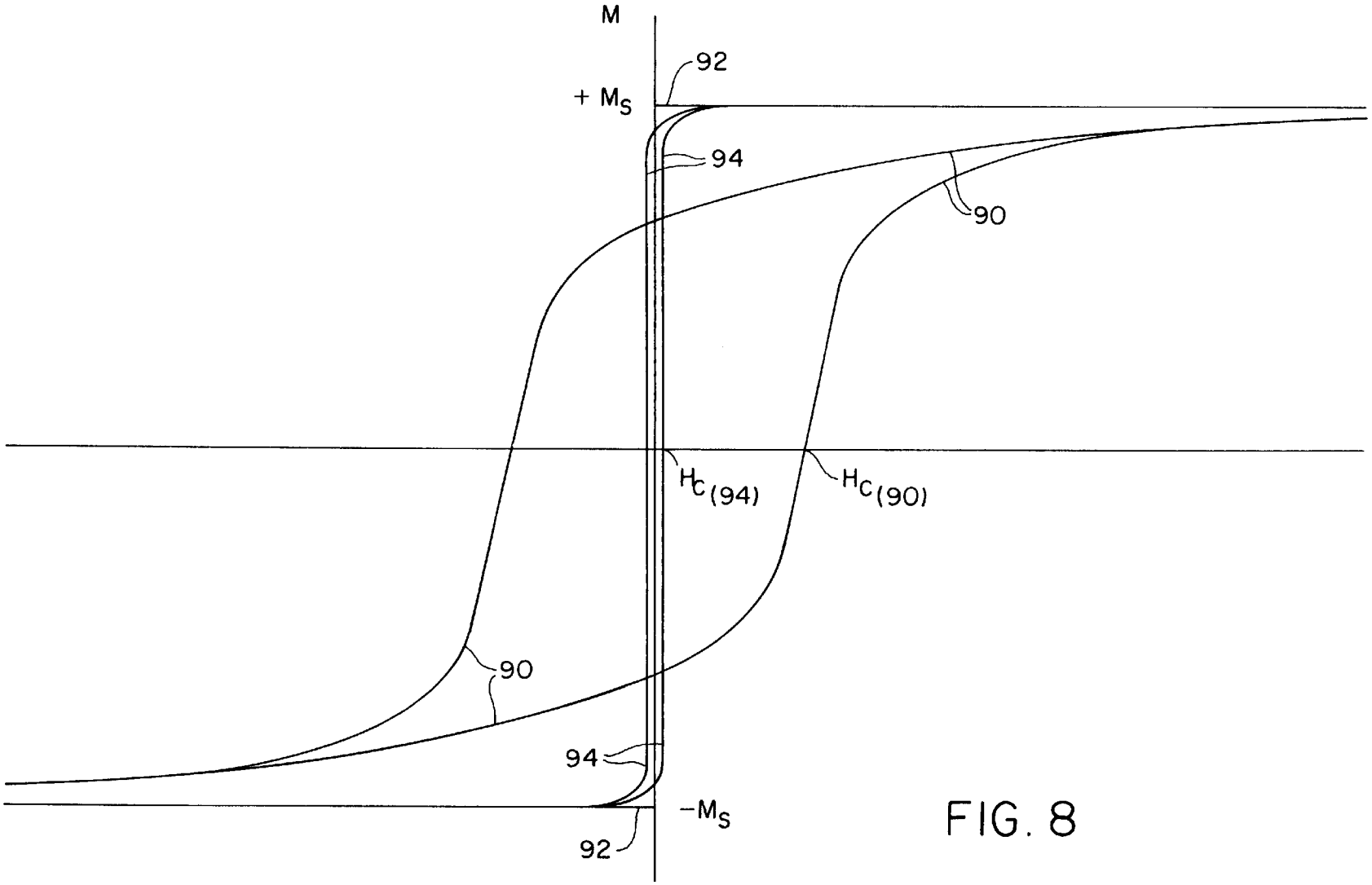
FIG. 8 is a magnetization chart illustrating the magnetic behavior of polycrystalline, quasi-single crystal and single crystal magnetic materials.

Such a material would not possess all of the single-crystal magnetic properties, but would simulate the shape of the single-crystal magnetization curve, i.e., a hysteresis loop with nearly square shape at low magnetic fields and with a vanishingly small coercive field $H_c$, as shown in FIG. 8, which illustrates the hysteresis behavior of the conventional polycrystalline material 90, quasi-single crystal material 94, and single crystal material 92 respectively. Optimum design of a quasi-single crystal ferrite material is expected to reduce $H_c$ by more than a factor of 2 and $K_l/M_s$ by more than a factor of 10.

We claim:

1. An electromagnetic device comprising:

a conductor for conducting an electromagnetic signal applied thereto;

a magnetic structure having a substantially closed-loop flux path comprised of a magnetic material having negligible coercivity, said structure being disposed in sufficient proximity to said conductor to enable gyromagnetic interaction between the signal and the structure in a region of gyromagnetic interaction; and an inducing circuit for inducing a magnetization in said magnetic structure which varies the propagation velocity of the signal in the region of gyromagnetic interaction.

2. The electromagnetic device of claim 1 wherein the inducing circuit induces a range of magnetizations between positive and negative magnetization saturation levels associated with the structure.

3. The electromagnetic device of claim 2 further comprising a demagnetizing zone disposed in the flux path of the magnetic structure to provide a substantially linear magnetization response between the positive and negative magnetization saturation levels.

4. The electromagnetic device of claim 3 wherein the demagnetizing zone comprises a gap and wherein the magnetization response between the positive and negative saturation levels is characterized by M=H(l/d) where M is said magnetization, H is a magnetic field applied by said inducing circuit for inducing said magnetization, l is the length of the flux path of the magnetic structure and d is the width of the gap.

5. The electromagnetic device of claim 1 wherein said magnetization is substantially confined within said magnetic structure.

6. The electromagnetic device of claim 1 wherein said conductor comprises a superconductor.

7. The electromagnetic device of claim 1 wherein the conductor provides a resonator structure such that the device operates as a filter, the filter having a frequency which varies with said magnetization.

8. The electromagnetic device of claim 1 wherein the conductor forms a meanderline such that the device operates as a phase shifter.

9. The electromagnetic device of claim 1 wherein the magnetic material comprises single crystal magnetic material, shaped with magnetically easy axes aligned along a direction of said magnetization.

10. The electromagnetic device of claim 1 wherein the magnetic material comprises quasi-single crystal magnetic material.

11. The electromagnetic device of claim 1 wherein the inducing circuit generates a continuous magnetic field for inducing the magnetization.

12. An electromagnetic device comprising:

a conductor in the form of a resonator structure having a defined fundamental frequency, for conducting an electromagnetic signal applied thereto;

a magnetic structure disposed in sufficient proximity to said conductor to enable gyromagnetic interaction between the signal and the magnetic structure in a region of gyromagnetic interaction; and a circuit for inducing a magnetization in the magnetic structure over a range of non-saturating magnetizations between positive and negative magnetization saturation levels associated with the structure, the induced magnetization varying the propagation velocity of the signal in the region of gyromagnetic interaction, thereby changing the fundamental frequency of the resonator structure.

13. The electromagnetic device of claim 12 wherein said conductor comprises a superconductor.

14. The electromagnetic device of claim 12 wherein the magnetic structure is substantially closed-loop and wherein the circuit comprises a coil for inducing the magnetization.

15. The electromagnetic device of claim 14 further comprising a demagnetizing structure disposed in the magnetic structure to provide a substantially linear magnetization response between the positive and negative magnetization saturation levels.

16. The electromagnetic device of claim 15 wherein the demagnetizing structure comprises a gap and wherein the magnetization response between the positive and negative saturation levels is characterized by M=H(l/d) where M is said magnetization, H is a magnetic field applied by said inducing circuit for inducing said magnetization, l is the length of the flux path of the magnetic structure and d is the width of the gap.

17. The electromagnetic device of claim 12 wherein the magnetic structure is comprised of a material selected from the group consisting of: single crystal material; polycrystalline material; and quasi-single crystal material.

18. A method for controlling the propagation velocity of an electromagnetic signal with a magnetic structure in a partially magnetized state comprising the steps of:

conducting the signal through a conductor;

forming a magnetic structure having a substantially closed-loop flux path of a magnetic material having negligible coercivity;

disposing said structure in sufficient proximity to said conductor to enable gyromagnetic interaction between the signal and the structure in a region of gyromagnetic interaction; and inducing a magnetization in said magnetic structure which varies the propagation velocity of the signal in the region of gyromagnetic interaction.

19. The method of claim 18 further comprising forming a demagnetizing zone in the magnetic structure to provide a substantially linear magnetization response between the positive and negative magnetization saturation levels.

20. The method of claim 18 wherein the step of inducing further comprises inducing a range of non-saturating magnetizations between positive and negative magnetization saturation levels associated with the structure.

21. A method for controlling the propagation velocity of an electromagnetic signal with a magnetic structure in a partially magnetized state comprising the steps of:

forming a conductor having a resonator structure with a defined fundamental frequency;

conducting the signal through the conductor;

disposing a magnetic structure in sufficient proximity to said conductor to enable gyromagnetic interaction between the signal and the magnetic structure in a region of gyromagnetic interaction; and inducing a magnetization in the magnetic structure over a range of non-saturating magnetizations between positive and negative magnetization saturation levels associated with the structure, the induced magnetization varying the propagation velocity of the signal in the region of gyromagnetic interaction, thereby changing the fundamental frequency of the resonator structure.

22. The method of claim 21 further comprising forming a demagnetizing zone in the magnetic structure to provide a substantially linear magnetization response between the positive and negative magnetization saturation levels.

23. A method for controlling the propagation velocity of a signal with a magnetic structure in a partially magnetized state comprising the steps of:

forming a conductor having a resonator structure with a defined fundamental frequency;

conducting an electromagnetic signal through the conductor;

disposing a magnetic structure in sufficient proximity to said conductor to enable gyromagnetic interaction between the signal and the magnetic structure; and inducing a magnetization in the magnetic structure over a range of non-saturating magnetizations between positive and negative magnetization saturation levels associated with the structure, the induced magnetization varying the propagation velocity of the signal in the region of gyromagnetic interaction, thereby changing the fundamental frequency of the resonator structure.

24. The method of claim 23 further comprising forming a demagnetizing zone in the magnetic structure to provide a substantially linear magnetization response between the positive and negative magnetization saturation levels.

25. An electromagnetic device comprising:

a conductor for conducting an electromagnetic signal applied thereto;

a magnetic structure having a substantially closed-loop flux path comprised of single crystal magnetic material, said structure being disposed in sufficient proximity to said conductor to enable gyromagnetic interaction between the signal and the structure; and an inducing circuit for inducing a magnetization in said magnetic structure which varies the propagation velocity of the signal in the region of gyromagnetic interaction.

26. The electromagnetic device of claim 25 wherein the inducing circuit induces a range of magnetizations between positive and negative magnetization saturation levels associated with the structure.

27. The electromagnetic device of claim 26 further comprising a demagnetizing zone disposed in the flux path of the magnetic structure to provide a substantially linear magnetization response between the positive and negative magnetization saturation levels.

28. The electromagnetic device of claim 27 wherein the demagnetizing zone comprises a gap and wherein the magnetization response between the positive and negative saturation levels is characterized by $M=H(l/d)$ where M is said magnetization, H is a magnetic field applied by said inducing circuit for inducing said magnetization, l is the length of the flux path of the magnetic structure and d is the width of the gap.

29. The electromagnetic device of claim 25 wherein said conductor comprises a superconductor.

30. The electromagnetic device of claim 25 wherein the conductor provides a resonator structure such that the device operates as a filter, the filter having a frequency which varies with said magnetization.

31. The electromagnetic device of claim 25 wherein said magnetization is substantially confined within said magnetic structure.

32. The electromagnetic device of claim 25 wherein the single-crystal magnetic material is shaped with magnetically easy axes aligned along a direction of said magnetization.

33. The electromagnetic device of claim 25 wherein the conductor forms a meanderline such that the device operates as a phase shifter.

34. The electromagnetic device of claim 25 wherein the circuit generates a continuous magnetic field for inducing the magnetization.

35. An electromagnetic device comprising:

a conductor in the form of a resonator structure having a defined fundamental frequency, for conducting an electromagnetic signal applied thereto;

a magnetic structure disposed in sufficient proximity to said conductor to enable gyromagnetic interaction between the signal and the magnetic structure; and a circuit for inducing a magnetization in the magnetic structure over a range of non-saturating magnetizations between positive and negative magnetization saturation levels associated with the structure, the induced magnetization varying the propagation velocity of the signal in the region of gyromagnetic interaction, thereby changing the fundamental frequency of the resonator structure.

36. The electromagnetic device of claim 35 wherein the magnetic structure is substantially closed-loop and wherein the circuit comprises a coil for inducing the magnetization.

37. The electromagnetic device of claim 36 further comprising a demagnetizing structure disposed in the magnetic structure to provide a substantially linear magnetization response between the positive and negative magnetization saturation levels.

38. The electromagnetic device of claim 35 wherein the magnetic structure is comprised of single crystal material.

39. The electromagnetic device of claim 35 wherein the magnetic structure is comprised of polycrystalline material.

40. A method for controlling the propagation velocity of a signal with a magnetic structure in a partially magnetized state comprising the steps of:

conducting an electromagnetic signal through a conductor;

forming a magnetic structure having a substantially closed-loop flux path of single crystal magnetic material;

disposing said structure in sufficient proximity to said conductor to enable gyromagnetic interaction between the signal and the structure; and inducing a magnetization in said structure which varies the propagation velocity of the signal in the region of gyromagnetic interaction.

41. The method of claim 40 wherein the induced magnetization is of a value within a range of magnetizations between positive and negative magnetization saturation levels associated with the structure.

42. The method of claim 41 further comprising forming a demagnetizing zone in the magnetic structure to provide a substantially linear magnetization response between the positive and negative magnetization saturation levels.

* * * * *